US006526989B2

(12) United States Patent
Sheffler et al.

(10) Patent No.: US 6,526,989 B2
(45) Date of Patent: Mar. 4, 2003

(54) COSMETIC POT WITH HIDDEN HINGE BETWEEN COVER AND BASE

(75) Inventors: Robert J. Sheffler, Morganville, NJ (US); Charles Chang, 55 Westview Rd., Wayne, NJ (US) 07470

(73) Assignee: Charles Chang, Wayne, NJ (US)

( * ) Notice: Subject to any disclaimer, the term of this patent is extended or adjusted under 35 U.S.C. 154(b) by 12 days.

(21) Appl. No.: 09/833,180

(22) Filed: Apr. 12, 2001

(65) Prior Publication Data

US 2002/0148481 A1 Oct. 17, 2002

(51) Int. Cl.[7] ..... A45D 33/24; A45D 33/22; B65D 43/14

(52) U.S. Cl. ..... 132/294; 132/295; 220/840

(58) Field of Search ..... 132/294, 295, 132/293, 300; 220/840, 842, 845, 4.22, 4.23

(56) References Cited

U.S. PATENT DOCUMENTS 3,476,123 A * 11/1969 Flax ..... 132/294
3,497,908 A * 3/1970 Zamarra ..... 220/840
4,666,068 A * 5/1987 Bush ..... 222/546
6,070,749 A * 6/2000 Joulia ..... 220/4.22
6,283,129 B1 * 9/2001 Yuhara et al. ..... 132/295

* cited by examiner

*Primary Examiner*—John J. Wilson
*Assistant Examiner*—Robyn Kieu Doan
(74) *Attorney, Agent, or Firm*—Charles I. Brodsky

(57) ABSTRACT

A cosmetic container including interleaved substantially vertical walls upwardly and downwardly extending respectively from a base component and from a product reservoir, with a further downwardly extending tongue projection from an underside of its cover, and in which cooperating detents on the tongue projection and on the reservoir pivot the cover open and closed, to form an internal hinge which is unobservable to a consumer, thereby providing a more aesthetically pleasing appearance to the container in both its opened and closed positions.

17 Claims, 9 Drawing Sheets

COSMETIC POT WITH HIDDEN HINGE BETWEEN COVER AND BASE

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to cosmetic pots, in general, and, to cosmetic dispensers which contain cosmetic substances such as rouges, blushes, pressed powders, balms, eyeliner/eyebrow coloring, skin treatments, and the like, in particular.

2. Description of the Related Art

As is well known and understood, such cosmetics pots generally take the form of double-walled jars having continuous thread finishes, and fitted with screw caps. Oftentimes constructed to have multiple compartments (to contain an additional applicator brush and/or a mirror, for example), such cosmetic pots are typically constructed of plastic in an attempt to present a smooth and polished exterior appearance.

As is also well known, such cosmetic pots could include some type of fastener—such as a hinge—to align a proper orientation between the cover or cap and the container lip. As it is recognized that the appearance of the final package is an important factor in promoting sales and consumer acceptance, those constructions in which the cover is externally hinged to the container base have been noted, to detract from the otherwise smooth and polished appearance of the container. In accordance with the teachings of the present invention, however, a new and improved cosmetic pot having a hinged cover is described, which is devoid of any exposure of the hinge with the base—or of any other structural detail which is not related to the mechanics required for the opening or closing of the final cosmetic container construction.

OBJECTS OF THE INVENTION

It is an object of the present invention, therefore, to provide an improved plastic cosmetic pot container characterized in this manner, and with as few a number of separate parts as is possible.

It is also an object of the invention to provide such a cosmetic container of plastic, which can be economically fabricated in simple molds.

It is another objection of the present invention to provide a plastic cosmetic container exhibiting these features, in which the opening and closing of the container is especially easy for a consumer to control, thereby enhancing the marketability of the cosmetic pot product.

It is a further object of the invention to provide such a cosmetic container in which the cover is hinged to the product reservoir, essentially within the container base rather than externally, so as to hide the hinge coupling from view.

It is yet another object of the invention to provide such a "hidden hinge coupling" for a cosmetic pot container, whether or not the cosmetic pot includes other dispensing compartments for applicator brushes, mirrors, etc. beyond the commonly contained cosmetic substances of rouge, blush powder, balm, eyeliner and eyelid coloring, and skin treatments, for example, and whether or not the cover is transparent to allow viewing of the cosmetic substances carried within.

SUMMARY OF THE INVENTION

Thus, and as will be seen, the cosmetic pot of the invention includes a base, a cover, and a product reservoir—which, when the pot is to be fabricated from plastic, can each be molded, traditionally to be circular or like compatible cross-sections. Circumferentially located around the internal wall of the base are a groove and shelf extending about its periphery interrupted only by a limited vertical doorway in the side wall.

The product reservoir, on the other hand, is of a compatible geometrical configuration, including a transverse member to rest on the shelf within the base, and a projecting ring that snaps within the groove of the base to be secured. Like the base, the main body portion of the product reservoir also includes a vertically oriented doorway or interruption in the wall, so that there is a corresponding alignment with the doorway of the base during assembly.

The cover of the cosmetic pot is dimensioned to fit over and seal the product reservoir and includes a projection extending downwardly from its underside to couple with a pair of walls which likewise extend downwardly from the underside of the product reservoir. With those downwardly extending walls from the product reservoir further coupling by a press-fit with a pair of walls extending upwardly from the base on either side of its vertically provided doorway, the product reservoir becomes secure within the base. With the downward projection from the cover connecting with the walls of the product reservoir by "detent coupling", the resulting hinge becomes pivotable about an axis inwardly of the fully assembled cosmetic container.

As will become clear from the following description, with the cover closed over the product reservoir, the resulting hinge is unobservable, and all that a consumer would see are the defining lines of the vertical doorway in the base. A completely finished appearance is thus exhibited by the cosmetic pot.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
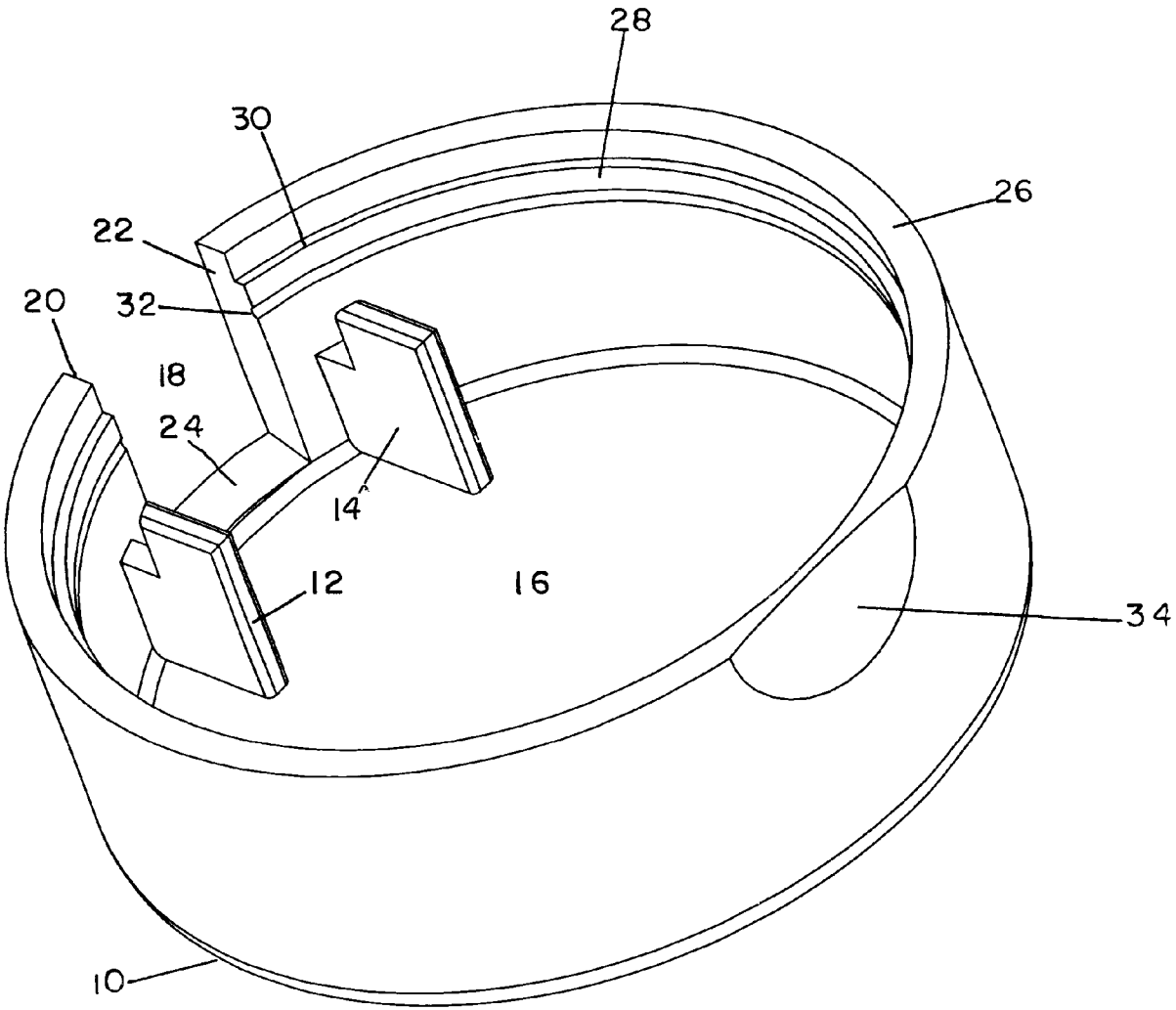
FIGS. 1–3 are pictorial views of the base component of the cosmetic pot invention as seen in three separate perspectives.

In FIGS. 1–3 and 8–9, the base component of the cosmetic container pot according to the invention is shown at 10, preferably molded from plastic and of generally circular cross-section and cylindrical configuration. A pair of inner walls 12, 14 extend upwardly from a transverse bottom surface 16 thereof at adjacent sides of a vertical doorway opening 18 formed within the base 10 (as defined by vertical surfaces 20, 22, and an intersecting horizontal surface 24). Internal to this interrupted wall 26 giving the base its shape is an inner shelf 28, which runs parallel to the bottom surface 16, and extending between the vertical surfaces 20, 22 in substantially the same configuration as the periphery of the base.

Figure 2:
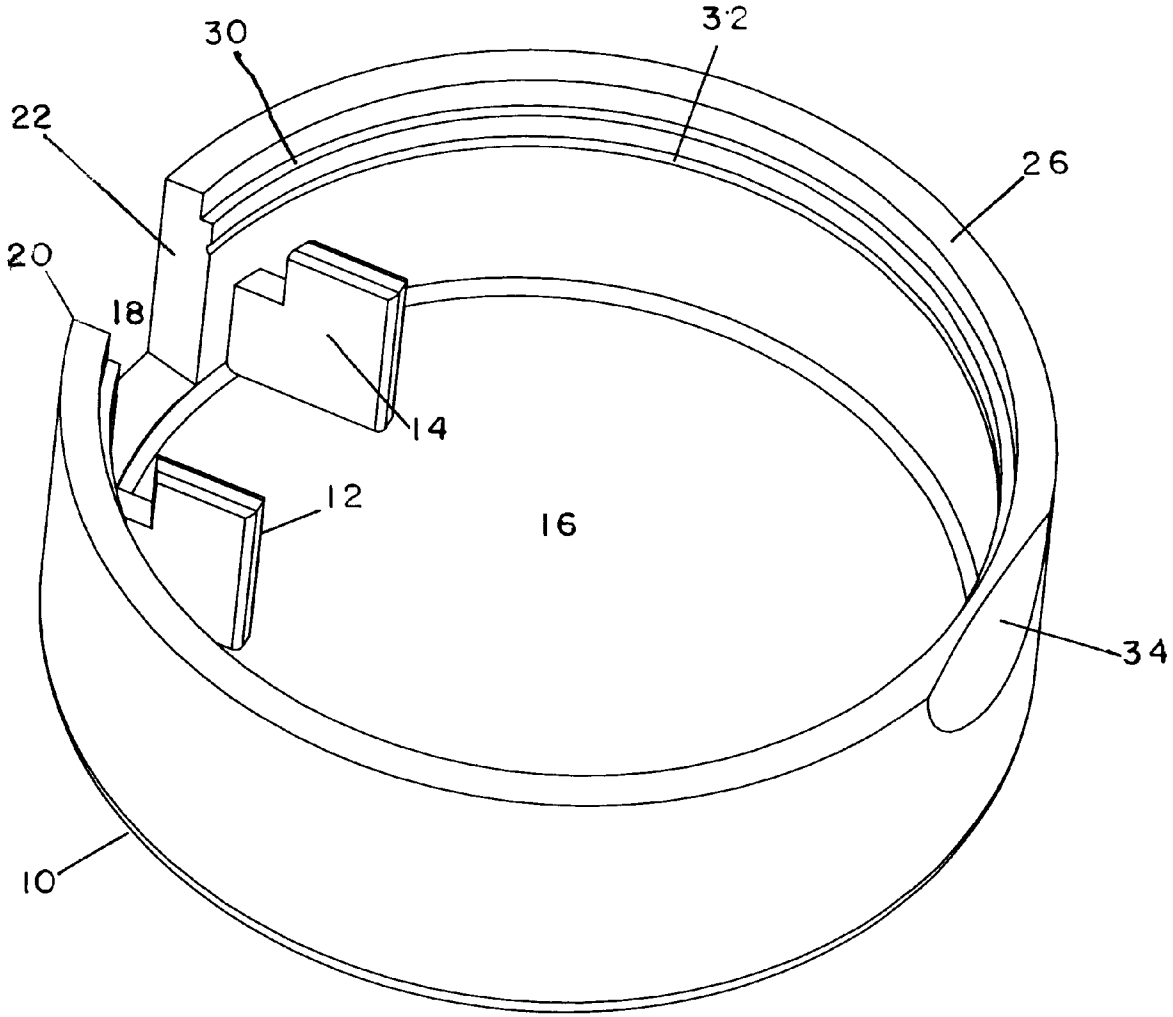

As shown in FIGS. 1 and 2, the shelf 28 includes a generally flat top segment 30, and a bottom segment which terminates in an inner groove 32. Both the flat segment 30 and the groove 32, as shown, extend from either side of the walls 20, 22 of the doorway opening 18, internally of the base 10 and along the interrupted wall 26. The base 10 is then completed by notching away an arcuate segment 34 at a location on the base generally opposite that of the opening 18 in establishing the "front" and "rear" of the cosmetic assembled container. As will be seen hereinafter, this notch assists in opening the cover of the container by a fingernail or finger pull.

The product reservoir of the cosmetic container pot shown in FIGS. 4–5 and 8–9 is of the same geometrical configuration as the base 10 so as to nest within it, —namely, of circular cross-section in the preferred embodiment, and similarly produced by plastic injection molding. Shown by the reference numeral 40, the product reservoir includes a recess 42 defined by a surrounding peripheral wall 44 and a transverse bottom surface 46 to receive the product to be stored and then later dispensed. Projecting perpendicularly downward from the bottom surface 46A (FIG. 5) are a pair of parallel walls 48, 50 formed as part of a second peripheral wall 52 extending outwardly from the peripheral wall 44 and of generally the same circular outline. As more clearly shown in FIG. 4, however, the second peripheral wall 52 terminates at vertical surfaces 54, 56 of the downwardly extending walls 48, 50, instead of continuing uninterrupted as does wall 44. The peripheral wall 52 further includes an outer shelf 58 and an outer rim or projecting ring 60 which extend about the periphery—both substantially parallel to the bottom surface 46, extending circularly from vertical surfaces 54, 56. Like the shelf 28, the shelf 58 also includes a flat top segment 57, along with a flat bottom segment 59.

Figure 3:
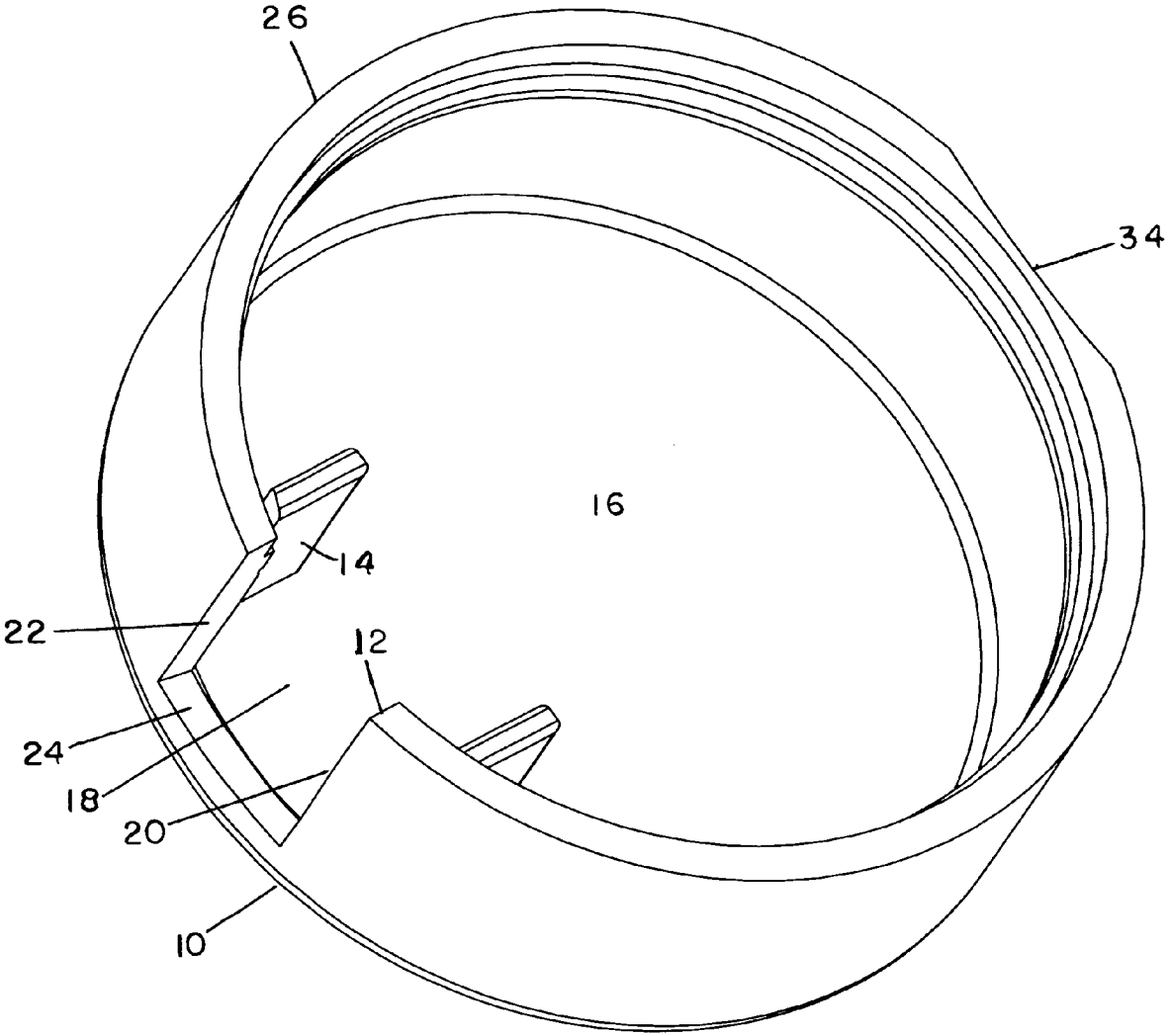
Figure 4:
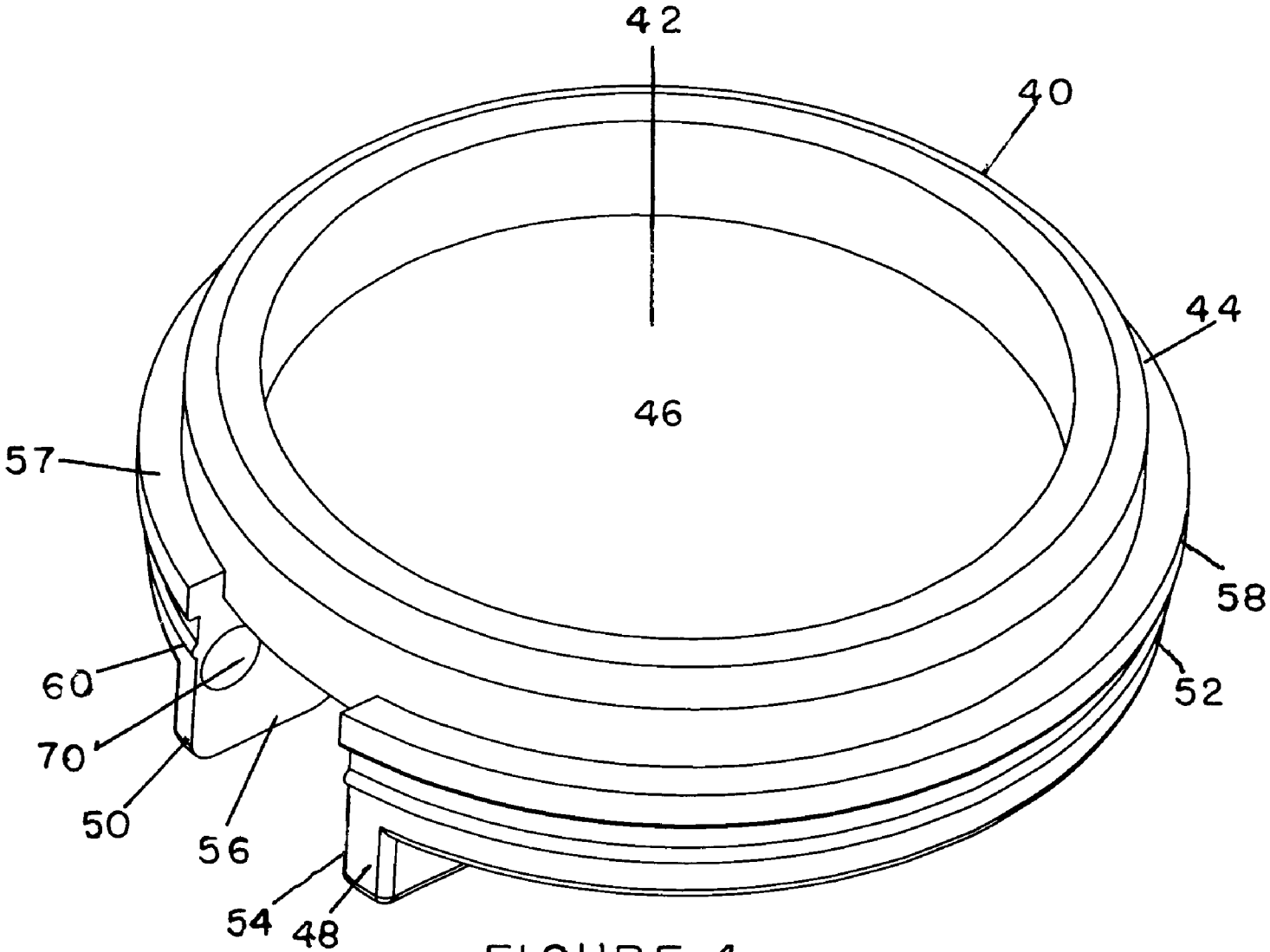
FIGS. 4–5 are top and bottom perspective views of the product reservoir.
Figure 5:
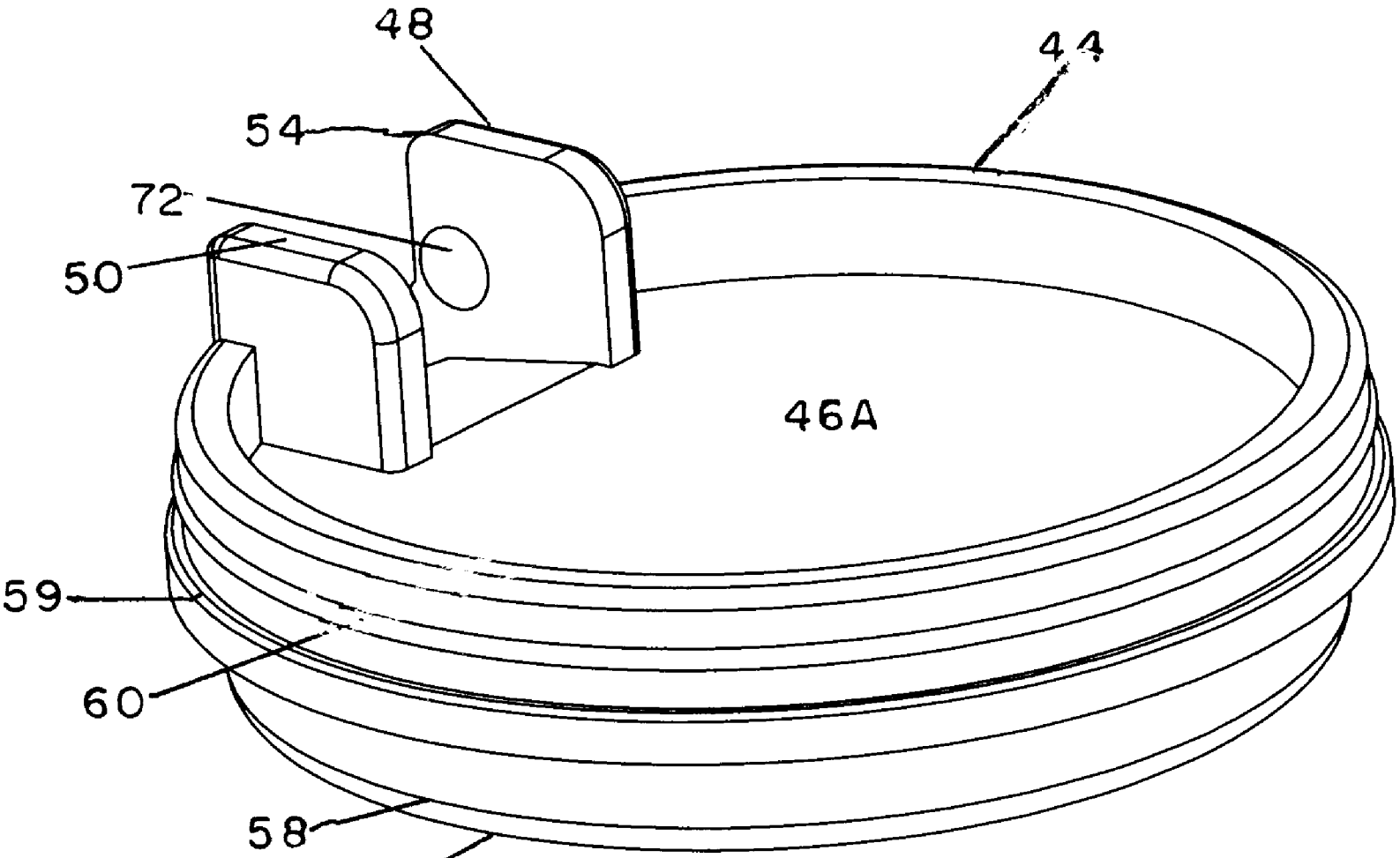
Figure 8:
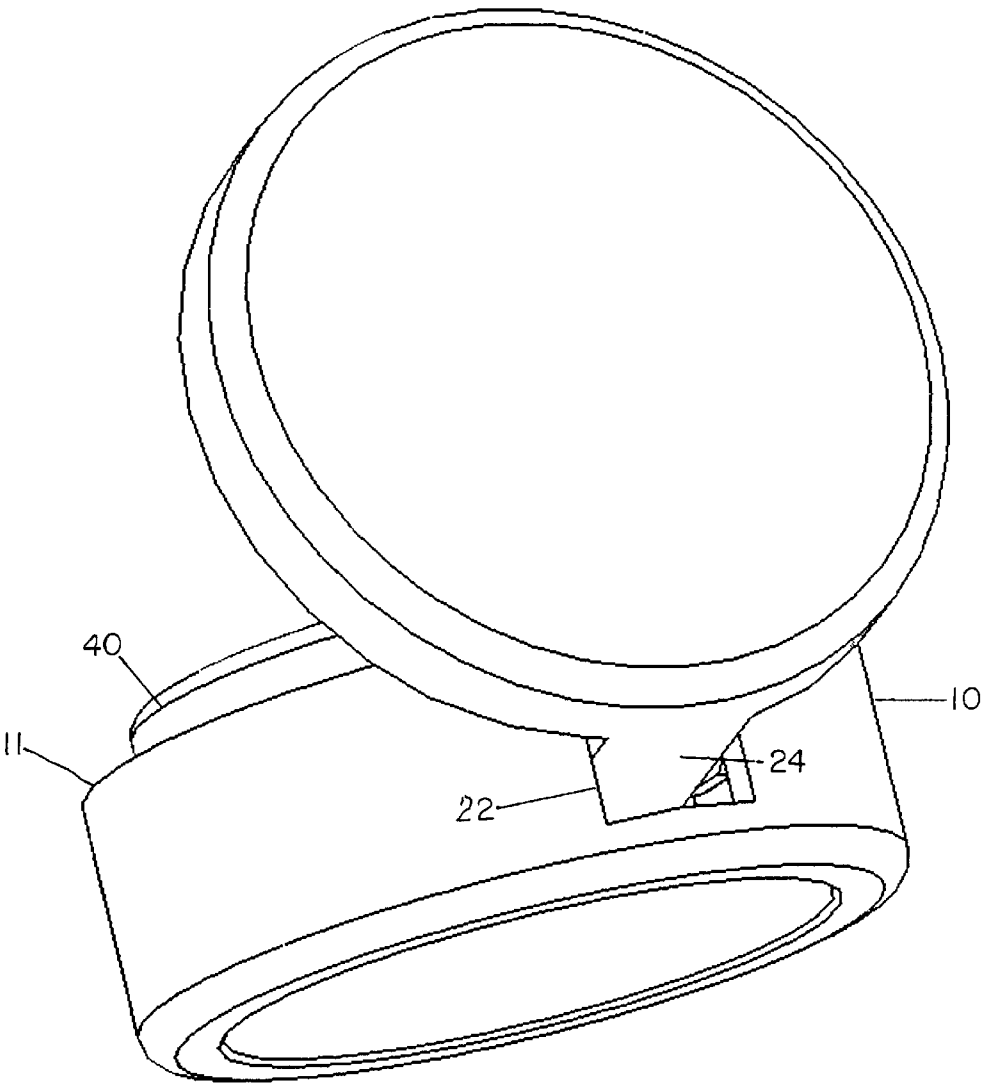
FIG. 8 is a perspective view of an assembled cosmetic pot embodying the invention as observable from a rear, underside position.

The configuration of the body 40 of FIGS. 4–5 allows it to snap within the base 10 of FIGS. 1–3, in an alignment so that the outer rim 60 of the interrupted peripheral wall 52 fits within the inner groove 32 of the interrupted wall 26, with the shelf 58 then resting upon the shelf 28. Seen in FIG. 9, such insertion fits the downwardly extending walls 48, 50 of the product reservoir 40 between the upwardly extending walls 12, 14 of the base 10, preferably by a press-fit with both pairs of walls 48, 50 and 12, 14 being parallel. Substantially only the peripheral wall 44 extends above the lip 11 of the base 10 when fitted in this matter (FIG. 8). To receive a hinged cover, the downwardly extending walls 48, 50 of the product reservoir 40 are provided with a pair of depressions 70, 72, inwardly of their vertical surfaces 56, 54 to serve as female detents.

Figure 6:
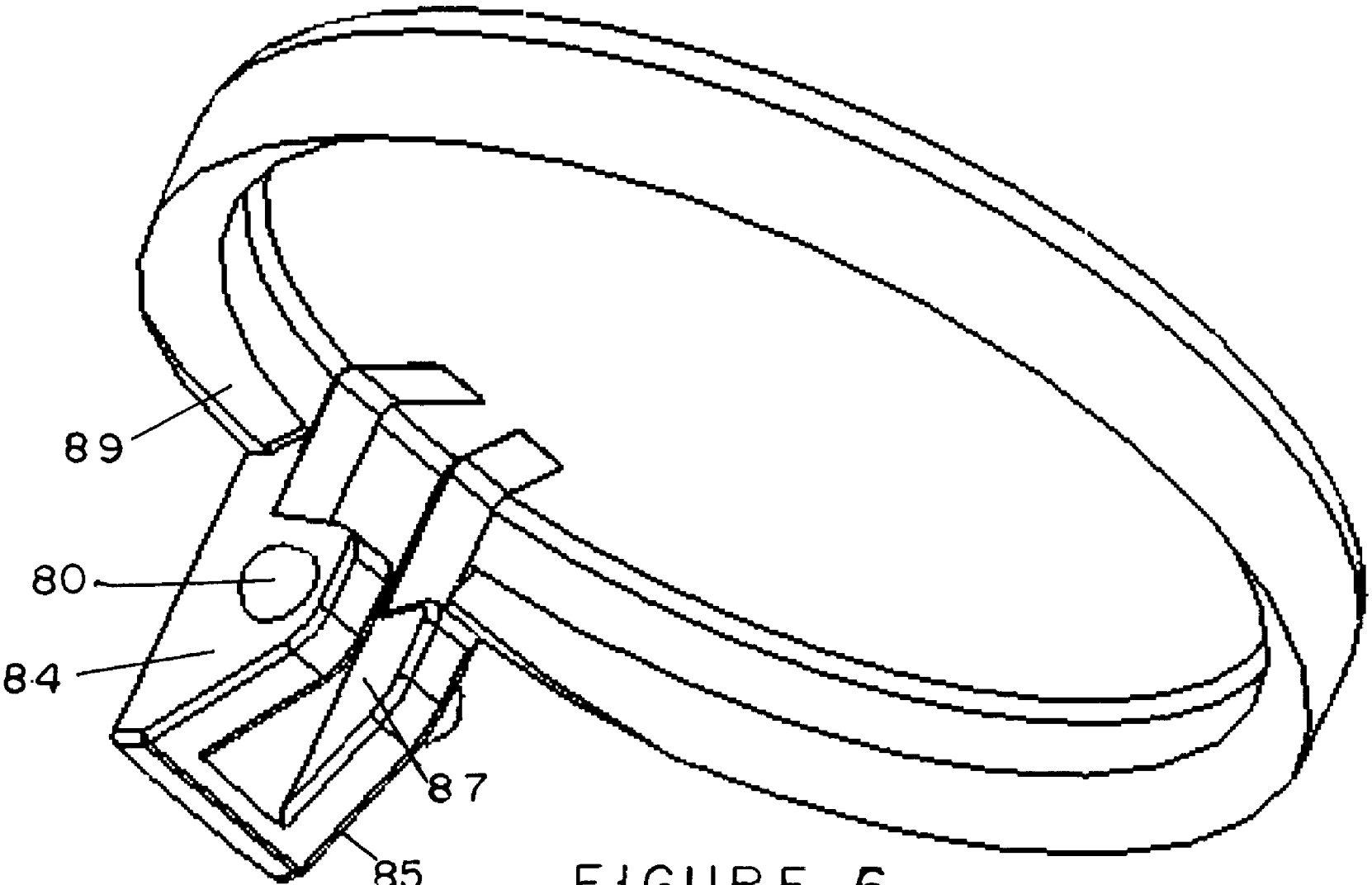
FIGS. 6–7 are pictorial views of the cover of the cosmetic pot as seen in two separate underside perspectives.
Figure 7:
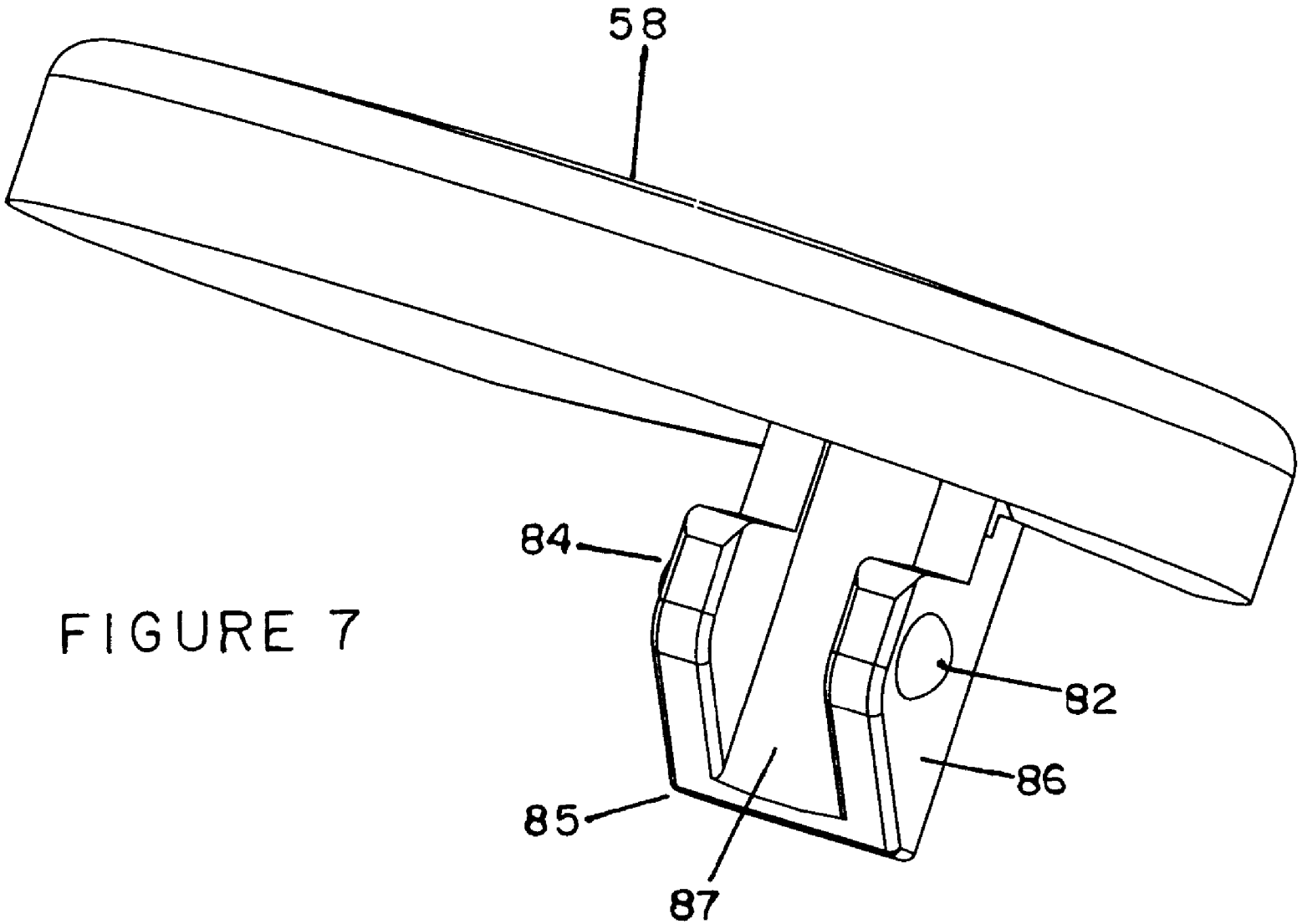
Figure 9:
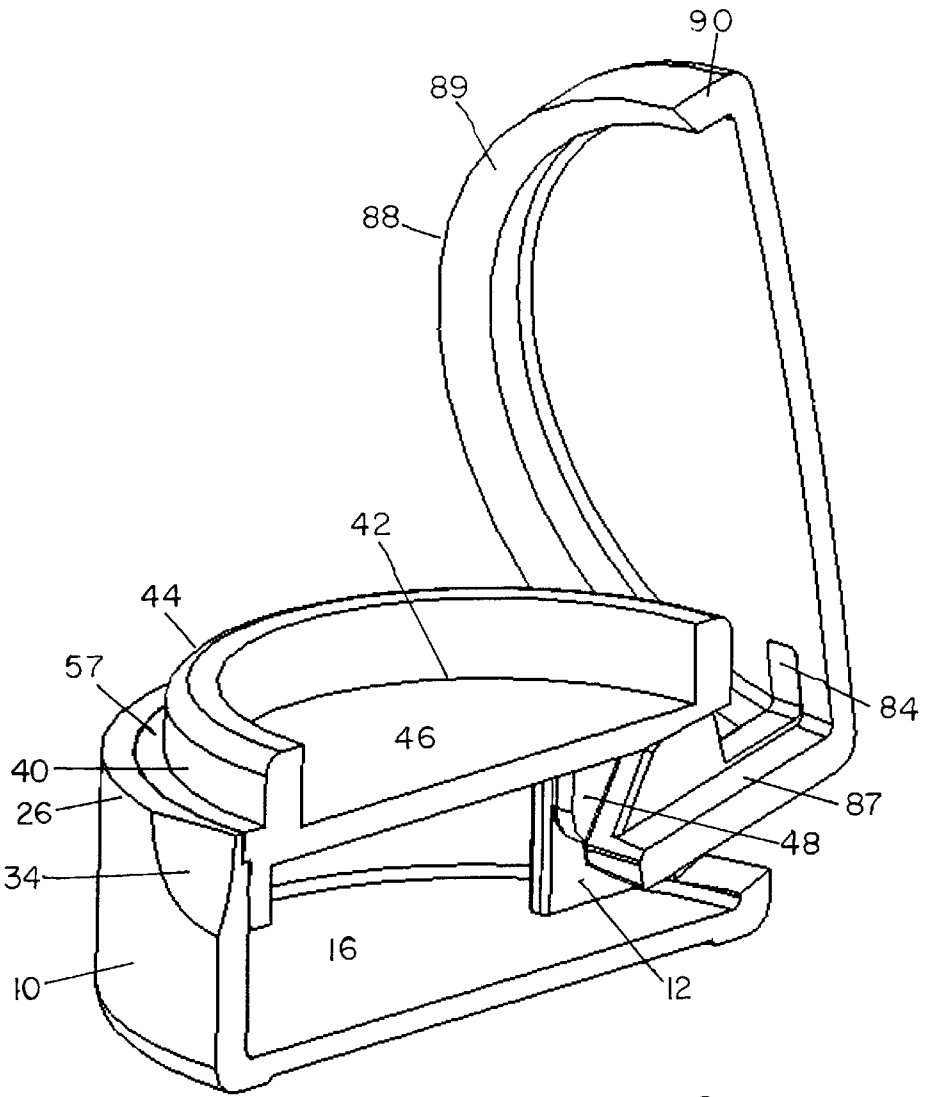
FIG. 9 is a perspective sectioned view of the assembled cosmetic pot seen from a front, top position, helpful in an understanding of its assembly.

The cover of the cosmetic container pot of the invention illustrated in FIGS. 6–9 (again for the preferred embodiment of a cosmetic pot of generally cylindrical construction) hinges open and closed with respect to the body 40 by male means of spherical segments. Shown by the nibs 80, 82, each detent is located on the outside surfaces 84, 86, respectively, of a tongue projection 85 extending downwardly from the underside 89 of the cover, shown at 88. The cover 88 is defined by an uninterrupted peripheral wall 90 of dimension to fit around and seal the product reservoir 40 through an overlapping of its peripheral wall 44, in resting on the flat segment 57 of the shelf 58. Contrasted with the base 10, the peripheral wall 90 of the cover 88 is continuous, without any notch 34 in the base 10 (FIG. 2). This allows for a fingernail or fingertip to be positioned at the notch 34 and upwardly lifted to raise the cover 88. As shown in FIGS. 6–7 and 9, the tongue projection 85 is U-shaped at 87 between its surfaces 84, 86, and of a width slightly less than that between the vertical surfaces 54, 56 of the downwardly extending walls 48, 50. This allows the male detents 80, 82 to slide between and then fit within the female detents 72, 70, respectively. The depth of the cover 88 is selected to fully encompass that extent of the peripheral wall 44 of the body 40 which extends beyond the lip 11 of the base 10.

In such manner, the cover 88 is arranged to pivot about the body 40 in opening and closing the cover 88 as a hinged lid, with the male-female detents 80, 72 and 82, 70 serving as the pivot points. When the cover is hinged open, as in FIG. 8, then, all that is viewable to a user are the outlines of the vertical doorway 18 in the base 10 and the rear of the tongue projection 85. When the cover 88 is hinged closed, this same doorway and tongue are viewable in full relief—but with the hinge hidden, and with the peripheral walls smooth, thereby providing an aesthetically pleasing appearance, to enhance eye-appeal and marketability. FIG. 9, in this respect shows, in a sectioned presentation, a front perspective view of the opened cosmetic container pot of the invention as to which FIG. 8 shows a rear perspective view.

While there have been described what are considered to be preferred embodiments of the present invention, it will be readily appreciated by those skilled in the art that modifications can be made without departing from the scope of the teachings herein. Thus, for example, while the cosmetic container pot has been described to have a cylindrical configuration, other configurations can be employed as well—whether or not the cover is transparent—, while continuing to retain the "hidden-hinge" feature obtainable through the interleaving of the vertical walls of the base and the body with the tongue projection of the cover. And, whereas the illustrated embodiment includes the female detents in forming the hinge as being on the body and the male detents as being on the cover tongue projection, such placements can just as easily be reversed—or other types of cooperating pivots employed there instead. For at least such reasons,—and for the further reason that the downwardly extending walls 48, 50 of the body 40 do not have to couple in a press-fit with the upwardly extending walls 12, 14 of the base 10 for the "hidden hinge" benefits of the construction to result, or for the reason that the placement of the inner groove 32 and the outer rim 60 could be reversed in fitting the body 40 with the base 10—resort should be had, therefore, to the claims appended hereto for a true understanding of the scope of the invention.

We claim:

1. A cosmetic container comprising:

a base of cross-section configuration defined by a first, interrupted peripheral wall, and having a first pair of substantially vertical walls extending upwardly;

a product reservoir of compatible cross-section configuration defined by a second, interrupted peripheral wall, and having a second pair of substantially vertical walls extending downwardly;

a cover of said compatible cross-section configuration defined by a third, uninterrupted peripheral wall, and including a projection having a third pair of substantially vertical walls extending downwardly; and means interleaving said first, said second and said third pairs of extending walls in aligning an interruption in said first defining wall with an interruption in said second defining wall, and in extending said projection through said aligned interruptions to couple said third pair of extending walls with said second pair of extending walls as a pivot point.

2. The cosmetic container of claim 1 wherein said means interleaves said first and said second pairs of substantially vertical walls in an interlocking fit.

3. The cosmetic container of claim 2 wherein said means interleaves said first and said second pairs of substantially vertical walls in a press fit.

4. The cosmetic container of claim 1 wherein said means interleaves said first and said second pairs of said substantially vertical walls in aligning said first interrupted peripheral wall with said second interrupted peripheral wall in an interlocking fit.

5. The cosmetic container of claim 4 wherein said means interleaves said first and said second pairs of substantially vertical walls in aligning said first and said second interrupted peripheral walls in a snap fit.

6. The cosmetic container of claim 1 wherein said means interleaves said first and said second pairs of substantially vertical walls and in aligning said interruptions in said first and said second defining walls.

7. The cosmetic container of claim 1 wherein said means interleaves said first, said second and said third pairs of extending walls in aligning vertical slot interruptions of orthogonal configuration in said first and said second defining walls through which a projection of rectangular cross-section couples to join with said second pair of extending walls as a hinge.

8. The cosmetic container of claim 7 wherein said projection includes a first detent along a length thereof to couple with a second detent on said second pair of extending walls.

9. The cosmetic container of claim 1 wherein an inner surface of said first, interrupted peripheral wall includes one of an inner groove and an outer rim and wherein an outer surface of said second, interrupted peripheral wall includes the other of said inner groove and outer rim.

10. The cosmetic container of claim 9 wherein said inner surface of said first, interrupted peripheral wall includes an inner groove and wherein an outer surface of said second, interrupted peripheral wall includes an outer rim to fit within said inner groove.

11. The cosmetic container of claim 1 wherein said means interleaves said second and said third pairs of substantially vertical walls in extending said projection through said aligned interruptions to couple to said second pair of walls as a snap fit.

12. The cosmetic container of claim 1 wherein said base also includes an inwardly extending shelf along an inner periphery of said first, interrupted wall and wherein said product reservoir includes an outwardly extending shelf along an outer periphery of said second interrupted wall.

13. The cosmetic container of claim 12 wherein said second shelf rests upon said first shelf.

14. The cosmetic container of claim 13 wherein said second shelf rests upon said first shelf to extend said product reservoir a distance above said base.

15. The cosmetic container of claim 14 wherein said projection is of a length, and said cover is of a depth, to overlap said cover about said base and said product reservoir when pivoted closed thereon.

16. The cosmetic container of claim 14 wherein said base, said product reservoir and said cover are fabricated of molded plastic.

17. The cosmetic container of claim 1 wherein said base also includes a downwardly cut arcuate notch in said first, interrupted peripheral wall opposite the interruption therein.

* * * * *